US007267635B2

(12) United States Patent
Ryan et al.

(10) Patent No.: US 7,267,635 B2
(45) Date of Patent: Sep. 11, 2007

(54) STATIONARY BIKE

(76) Inventors: Allen L. Ryan, 2218 N. Clybourn, Chicago, IL (US) 60614; Thomas DeSilvia, 105 W. Kathleen Dr., DesPlaines, IL (US) 60016; Thomas Smith, 5975 Chase Ave., Downers Grove, IL (US) 60516; Thomas Danowski, 923 Gregory La., Schaumburg, IL (US) 60193

( * ) Notice: Subject to any disclaimer, the term of this patent is extended or adjusted under 35 U.S.C. 154(b) by 1 day.

(21) Appl. No.: 11/168,030

(22) Filed: Jun. 28, 2005

(65) Prior Publication Data

US 2005/0239610 A1 Oct. 27, 2005

Related U.S. Application Data

(62) Division of application No. 09/963,970, filed on Sep. 26, 2001, now Pat. No. 6,913,560.

(51) Int. Cl.
*A63B 22/00* (2006.01)

(52) U.S. Cl. ..... 482/51; 74/594.1

(58) Field of Classification Search ..... 482/51, 482/57–59; 74/594.1–594.3; 280/259–262
See application file for complete search history.

(56) References Cited

U.S. PATENT DOCUMENTS

| | | | | | |
|---|---|---|---|---|---|
| 4,201,120 | A * | 5/1980 | Segawa | 74/594.2 |
| 4,358,967 | A * | 11/1982 | Kastan | 74/594.2 |
| 5,423,728 | A * | 6/1995 | Goldberg | 482/57 |
| 5,626,060 | A * | 5/1997 | Lin | 74/594.1 |
| 5,644,953 | A * | 7/1997 | Leng | 74/594.2 |
| 5,860,329 | A * | 1/1999 | Day | 74/594.1 |
| 6,053,520 | A * | 4/2000 | Wu | 280/259 |
| 6,296,072 | B1 * | 10/2001 | Turner | 180/220 |

* cited by examiner

*Primary Examiner*—Lori Amerson
*Assistant Examiner*—Tam Nguyen

(57) ABSTRACT

A stationary exercise bicycle is provided having a frame, a resistance member, a drive assembly, a right pedal, a left pedal, a seat and an adjustable seat mechanism utilizing a rack. Assembly and disassembly of a three piece crank arm assembly is accomplished without requiring the assembling and disassembling of the entire drive assembly. The stationary exercise bicycle also provides a variety of users with an optimum seat position and with a convenient latch mechanism to adjust the position of the seat.

9 Claims, 8 Drawing Sheets

STATIONARY BIKE

CROSS REFERENCE TO RELATED APPLICATION

This application is a divisional of U.S. Application Ser. No. 09/963,970 filed on Sep. 26, 2001 and now U.S. Pat. No. 6,913,560, which is herein incorporated by this reference.

FIELD OF THE INVENTION

The present invention relates generally to an exercise device, and more particularly to a stationary, upright exercise bike.

BACKGROUND OF THE INVENTION

Bicycling is recognized by the avid mountain and road cyclists riding on hilly or mountainous terrain or by the average or "Sunday" rider as a particularly effective type of aerobic exercise. Also, bicycling provides a low impact type of exercise which is especially easy on the knees and feet. As a result, stationary exercise bicycles facilitating this type of exercise are popular for both home and health club use.

Conventional crank assemblies for stationary exercise bicycles usually include a drive pulley that in turn is connected by a belt or a chain to a load device such as an alternator or mechanical brake in order to provide resistance to the user's pedaling. These crank assemblies often include fastener-holes formed in the drive pulley, a crank hub, and an elongated crank arm which has an upper portion formed integrally with the drive pulley and a lower end portion formed with a threaded hole in which a pedal of the stationary exercise bicycle is mounted. The drive pulley has a central opening that permits a fixed rotating shaft to extend therethrough in such a manner that the drive pulley can rotate synchronously with the pedal. Screws are inserted through the fastener-holes of the drive pulley and the crank arm, thereby completing assembly of the conventional crank assembly.

Note: that it is difficult to repair and maintain the conventional crank assembly as a result of the above described construction. When repair or maintenance of the conventional crank assembly is required, the entire assembly including the drive pulley, the crank hub and the elongated crank arm must be disassembled. In addition to substantially increasing manufacturing and repair expense, the conventional crank assembly tends to be noisy. As a result, the crank hub frequently becomes loose and requires frequent maintenance. Thus, it is desirable to decrease the manufacturing expense, reduce maintenance costs and decrease noise of stationary exercise bicycle apparatuses.

With respect to operation of exercise bicycles, research has shown that the optimum position seating for bicycling is for the seat to be at a height that allows for approximately 15 degrees of leg bend when the rider's foot is at the lowest pedal position and for the seat post to be positioned rearwardly of the pedal crank and along a line passing through the pedal crank at an angle of approximately 71 degrees from the horizontal. Thus, the seat positioning requirements for optimum performance vary greatly from rider to rider.

It has also been found that even slight movements of seat position will work either different muscles and/or different parts of the muscles. Typical seat position mechanisms provide only widely spaced adjustments which can limit the user's ability to comfortably work different muscles.

In view of these issues and others, it is clear that a highly adjustable seat positioning system is needed, one that is easily controlled. The most common form of seat adjustment involves using a pin, usually secured to the exercise bikes frame and often spring loaded, that is inserted into one of a number of holes in the seat post in order to position the seat. However, this arrangement has a number of disadvantages including the necessity of dismounting the bike to pull the pin out and because of the spacing of the holes on the post, the seat can only be positioned in increments that are on the order of one inch. One approach to solving this problem has been implemented on an exercise bicycle manufacture by Cybex Intl. of Medway, Mass. In this product, the seat post is configured with openings having a flap portion bent inwardly on the lower edge each of the openings which permit the user to pull the seat up to a new position without pulling the pin out. This arrangement provides a ratchet effect in that the flaps will guide the pin out of the openings while the seat post is moving up. However, it is still necessary for a user to manually pull the pin out to lower the seat. Also, the shape of the openings results in vertical seating increments of at least one inch.

SUMMARY OF THE INVENTION

It is, therefore, a principal object and purpose of the present invention to provide an exercise apparatus that accurately and dynamically simulates bicycling, and is of a simple design.

It is an additional principal object and purpose of the present invention to provide a stationary exercise bicycle apparatus that is easy to repair and maintain including the ability to disassemble the crank arm without disassembling the entire drive assembly.

It is another principal object and purpose of the present invention to provide a stationary exercise bicycle apparatus that provides a variety of users with an optimum seat position.

It is an additional principal object and purpose of the present invention to provide a stationary exercise bicycle apparatus that provides the user with a convenient method to adjust the position of the seat.

These and other objectives and advantages are provided by the present invention which is directed to a stationary exercise bicycle apparatus that is easy to repair and maintain and permits a more accurate and convenient adjustment of seat position. The stationary exercise bicycle apparatus includes a frame that is adapted for placement on the floor, a resistance mechanism which provides a resistive force to pedals, a drive assembly, a drive belt connecting the drive assembly to the resistive force generating mechanism, right and left pedals, and an adjustable seat mechanism.

The invention can also include a data input means and a control means. The data input means permits the user to input control signals. The control means responds to the input control means to control the resistance member and apply a braking force to the pedals. The user can thus control the amount of resistance offered by the pedals and so can vary the degree of effort required to move the pedals. The invention thus can accommodate the individual needs and desires of different users.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
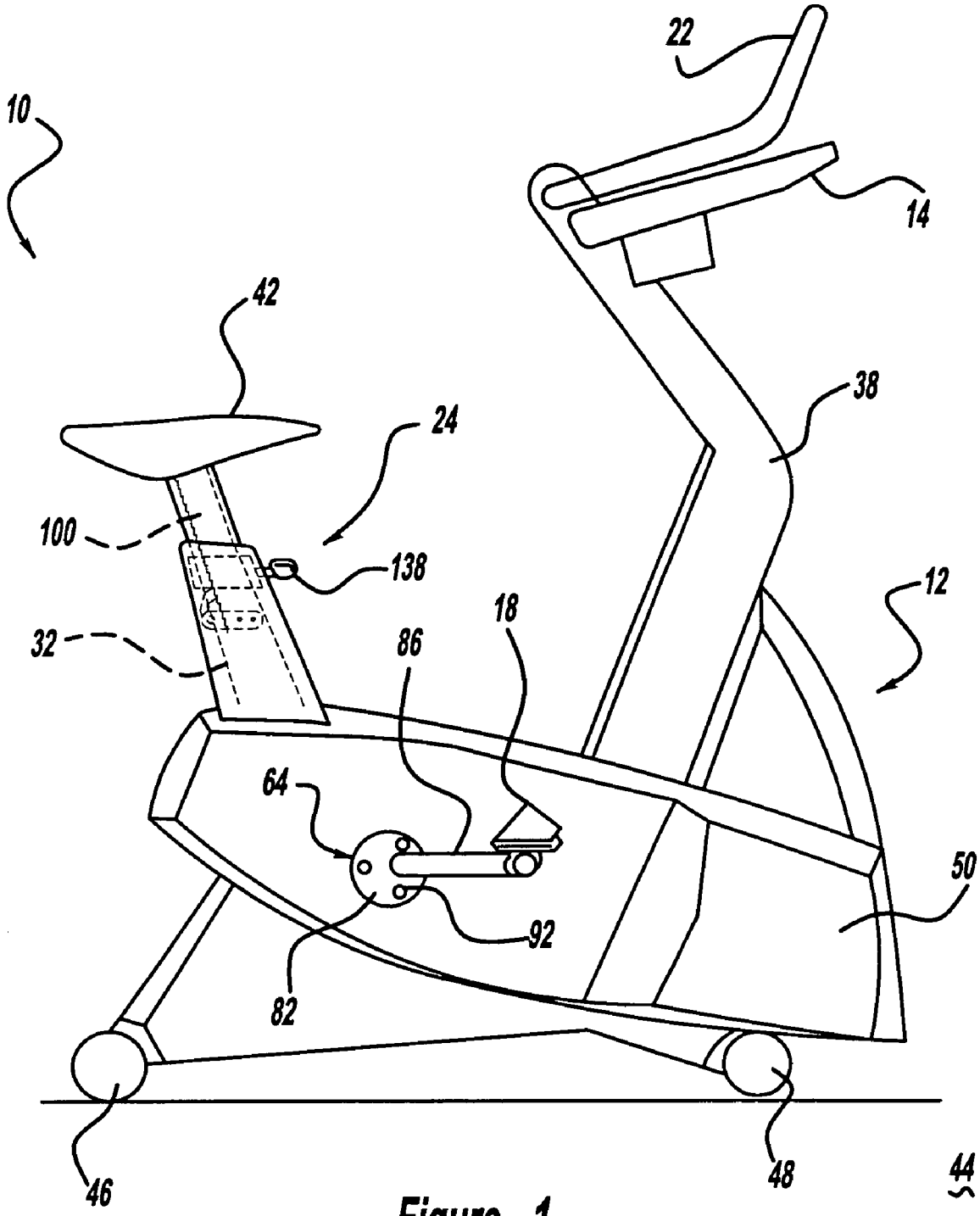
FIG. 1 is a side view of a stationary exercise bicycle apparatus in accordance with the invention.
Figure 2:
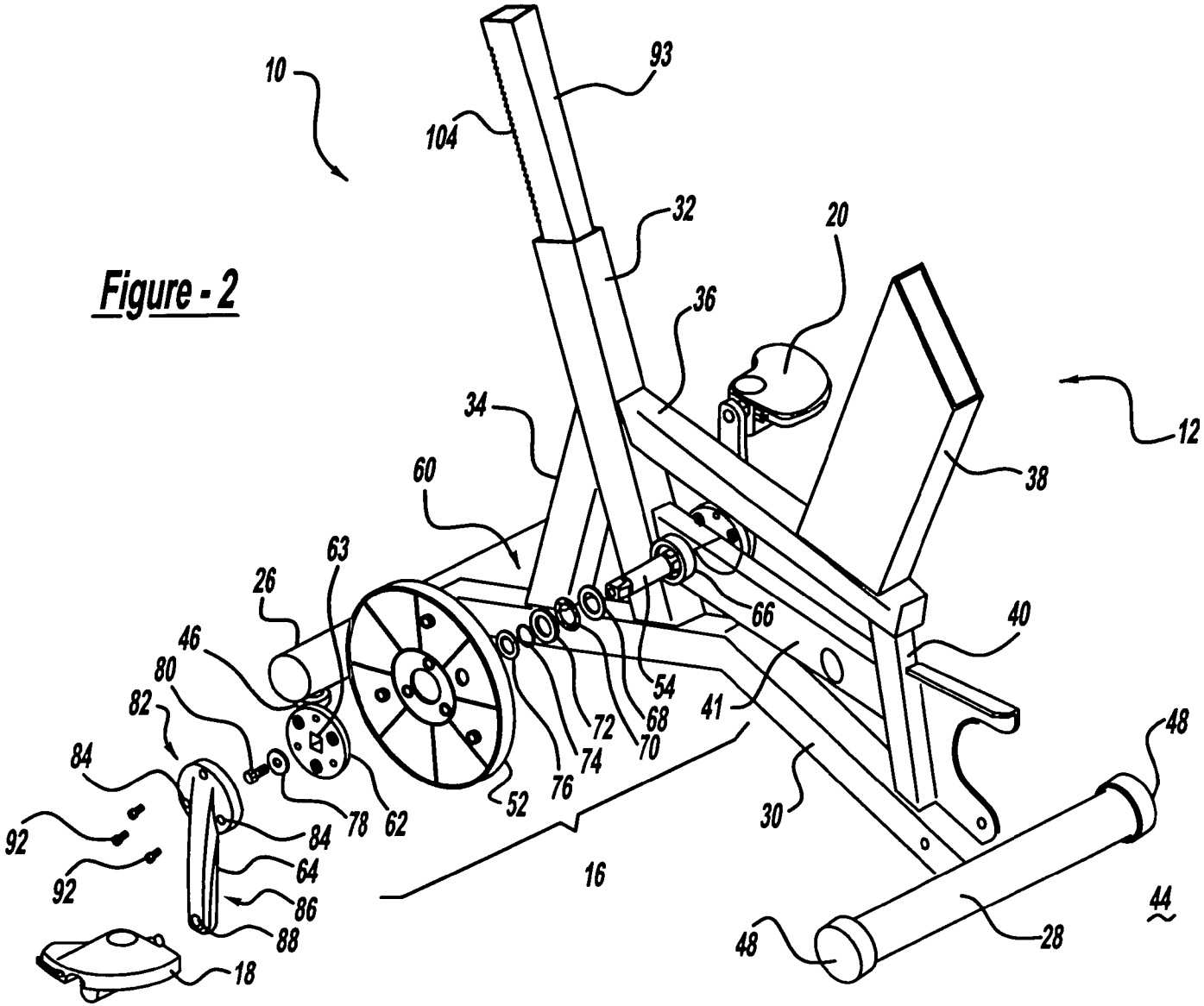
FIG. 2 is an exploded right side perspective view of a drive assembly for use with the stationary exercise bicycle apparatus in FIG. 1.

Referring to the drawings in detail, FIG. 1 and FIG. 2 depict a stationary exercise bicycle apparatus 10 that includes a tubular frame 12, a control panel 14, a drive assembly 16, a right pedal 18, a left pedal 20, handgrips 22 and an adjustable seat mechanism 24. The frame 12 acts as the supporting structure for the stationary exercise bicycle apparatus 10 and can be of any suitable construction. It should also be understood that a variety of different frame structures can be used to support the elements of the apparatus 10 such as the frames used in the current existing stationary exercise bicycles. In the illustrated preferred embodiment, the frame 12 includes a rear cross member 26, a front cross member 28, a slightly bent longitudinal support member 30 secured to and between the rear cross member 26 and the front cross member 28, a first vertical support member 32 secured to the longitudinal support member 30, a bracing member 34 secured to and between the longitudinal support member 30 and the first vertical support member 32, a horizontal support member 36 secured to the first vertical support member 32, a second vertical support member 38 secured to the horizontal support member 36, a second support member 40 secured to and between the horizontal support member 36 and the longitudinal support member 30, and a central horizontal support member 41 secured to and between the first vertical support member 32 and the second support member 40. The first vertical support member 32 provides support for the adjustable seat mechanism 24 and a seat 42. The second vertical support member 38 provides support for the control panel 14 and the handgrips 22.

The rear cross member 26 and the front cross member 28 are configured for placement on a floor 44. Levelers 46 are provided on the rear cross member 26 so that if the floor 44 is uneven, the rear cross member 26 can be raised or lowered such that the rear cross member 26, the longitudinal support member 30 and the front cross member 28 are substantially level. Rollers 48 are provided on the front cross member 28 so that the stationary exercise bicycle apparatus 10 can be easily moved from one location to another.

The stationary exercise bicycle apparatus 10 also includes a right housing shown at 50 and a similar left housing 51 to protect and shield from view the internal components of the stationary exercise bicycle apparatus 10. As is the case with most exercise bicycles, centrally locating the internal components, essentially between the legs of the user, provides for stability and allows for a lightweight and simple design.

It should be noted that the exercise bicycle 10 as described above is representative of a large array of existing stationary exercise bicycles and is used to provide the preferred environment for the inventions described herein.

Figure 3:
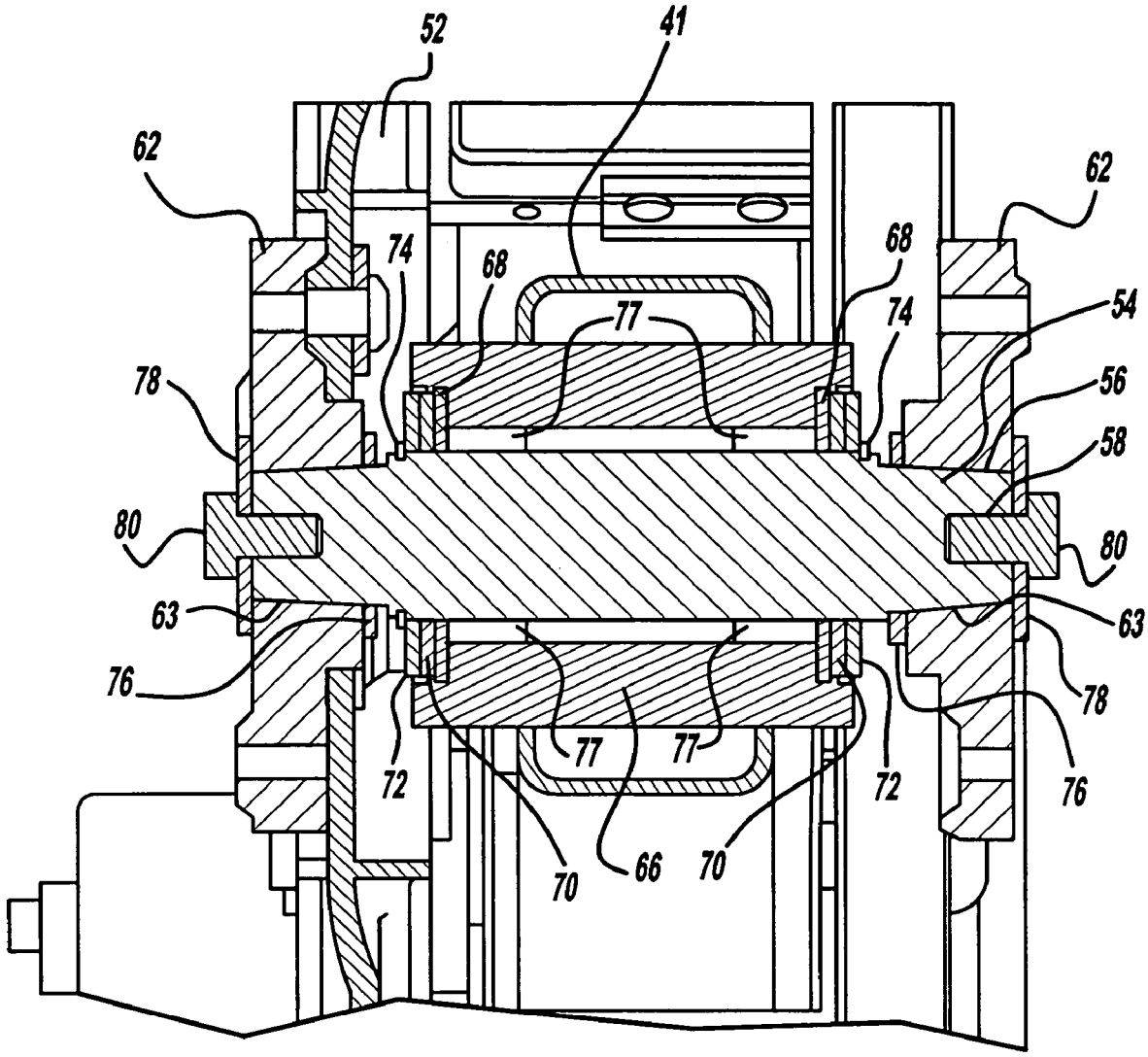
FIG. 3 is a rear sectioned view of a portion of the drive assembly shown in FIG. 2.

FIGS. 2 and 3 depict the operation and components of the the drive assembly 16 which is similar to the operation and description of the left side portion, except for the inclusion of a pulley member or in this case a drive pulley 52 on the right side. Thus, only the operation and description of the right side portion of the drive assembly 16 will be discussed. Also, it should be noted that the drive pulley 52, as is conventional in stationary exercise bicycles, engages a drive belt (not shown) that in turn is engaged with a resistance mechanism (not shown). In addition, it should be understood, that the invention described herein would, for example, equally apply to a sprocket and chain arrangement rather than the pulley 52 and belt arrangement, in other words, a sprocket can perform the equivalent function of the drive belt pulley 52. By the same token, a variety of different types of variable resistance mechanisms can be used such as alternators, eddy current brakes or mechanical brakes. As illustrated in FIGS. 2 and 3, the drive assembly 16 is rotatably mounted to the central horizontal support member 41 by a shaft 54. In the preferred embodiment of the invention, each end 56 of the shaft 54 has a square cross section and is tapered. Each end 56 of the shaft 54 also includes a threaded bore 58.

The preferred embodiment of the drive assembly 16 includes a carriage assembly 60, the drive or crank pulley 52, a crank disc or hub 62 having a taped central aperture or opening 63 and a crank arm 64. The carriage assembly 60, which is mounted to the shaft 54, includes a frame crank bushing 66, a first thrust washer 68, an axial needle bearing 70, a second thrust washer 72, a bowed retainer ring 74, a second retainer ring 76 and a set of radial bearings indicated at 77. The second thrust washer 72 and the retainer ring 74 serve to hold the shaft 54 within the frame crank bushing 66.

Similarly, the crank pulley 52 is mounted on the hub 62 for rotation therewith. As described above, the drive pulley 52 is associated with only one side portion of the drive assembly 16. As illustrated in FIGS. 2 and 3, the crank pulley 52 is shown on the right side portion of the drive assembly 16. However, the crank pulley 52 can be located on the left side portion of the drive assembly 16. The crank discs or hubs 62 are also mounted on the shaft 54 such that tapered ends 56 fit securely in the taped aperture 63 of the hub 62. As illustrated in FIGS. 2 and 3, the second retainer ring 76 aids in positioning the crank disc or hub 62 on the shaft 54. While in this position, the crank disc or hub 62 engages the crank pulley 52.

Additionally included in the drive assembly 16 is a drive washer 78 and a drive bolt 80. The drive washer 78 abuts the hub 62 while the drive bolt 80 engages the threads in the bore 58 formed in the shaft 54. The drive washer 78 and the drive bolt 80 thereby serve to retain the crank disc or hub 62 on the shaft 54.

With continued reference to FIG. 2, the crank arm 64 engages the crank disc or hub 62. The crank arm 64 includes an upper mounting portion 82 having fastener receiving apertures 84 formed therein and an arm portion 86 having a threaded aperture 88 formed at its end. The right pedal 18 is rotatably secured to the arm portion 86 of the crank arm 64 at the aperture 88. The crank arm 64 is secured to the hub 62 by, preferably, a set of three fasteners such as a set of three screws shown at 92. More or less and differently spaced fastener members can be used for this purpose. The screws 92 extend through the apertures 84 formed in the mounting portion 82 of the crank arm 64. In this embodiment of the invention, the crank arm 64 can be mounted to the stationary exercise bicycle apparatus 10 after the housings 50 and 51 are secured in place. Thus, as described above, the assembly and disassembly of the crank arm 64 is accomplished without requiring the assembling and disassembling of the crank disc or hub 62, the crank pulley 52 or the carriage assembly 60, thereby substantially facilitating repair and maintenance of the drive assembly 16.

FIGS. 1 and 4-6, depict the preferred embodiment of an adjustable seat mechanism 24 for use with the stationary bicycle 10. Although, the seat mechanism 24 can be used with many different types of exercise bicycles, as well as other types of exercise equipment, for convenience it is described herein within the context of the stationary bicycle 10. As previously described, the first vertical support member 32 of the frame 12 provides support for the adjustable seat mechanism 24. In this embodiment, a seat post or tube 93 for supporting the seat 42 is configured to move up and down within the first vertical support member 32. The seat post 93 is configured with a channel 94 and also slides up and down within a collar member 96 which in turn is secured to the upper portion of the first vertical support member 32. The vertical support member 32 also includes an aperture 98 for receiving a portion of the seat mechanism 24.

Figure 7:
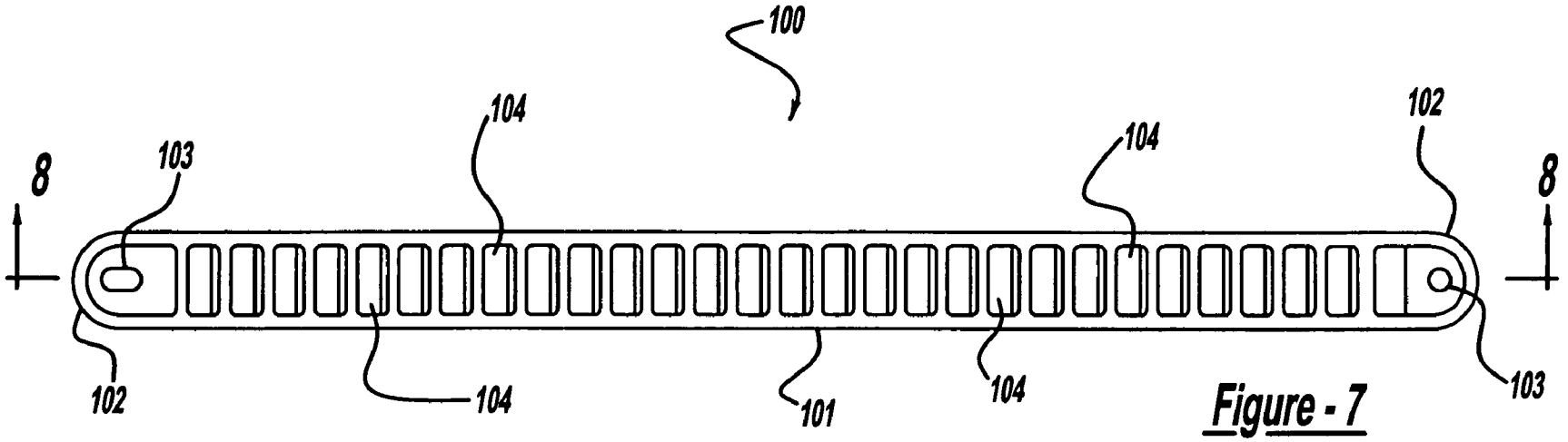
FIG. 7 is a top view of a rack mechanism for use with the adjustable seat mechanism shown in FIGS. 1 and 4-6.
Figure 8:
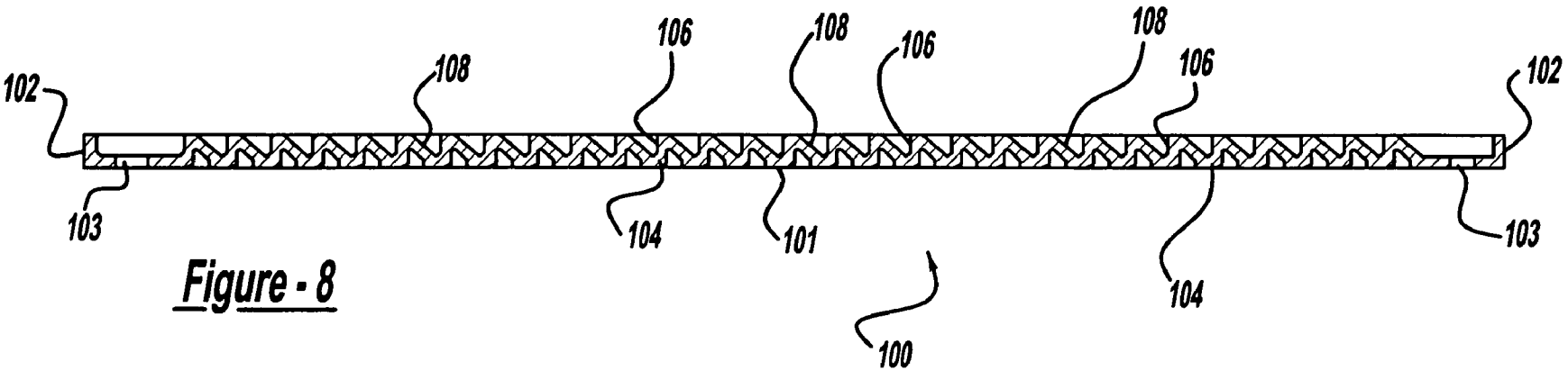
FIG. 8 is a sectioned side view of the rack mechanism taken along the direction indicated by a line 8-8 as shown in FIG. 7.

A rack 100 is disposed within the channel 94 formed in the seat post 93. With reference to FIGS. 7 and 8, the rack 100 includes an elongated central portion 101 with semi-circular end portions 102 having apertures 103 for receiving fasteners (not shown) for securing the rack 100 to the seat post 93 in the channel 94. It should be noted that the rack 100 can be secured to the seat post 93 by a variety of methods including welding to the seat post 93 or made integral with the seat post 93. The rack 100 includes a large number of closely spaced teeth 104. As shown in FIG. 8, each of the teeth 104 includes a horizontal surface 106 and an angled surface 108. Because a large number of closely spaced teeth 104 are used on the rack 100, it is possible to provide a large number of vertical positions of the seat 42.

Figure 5:
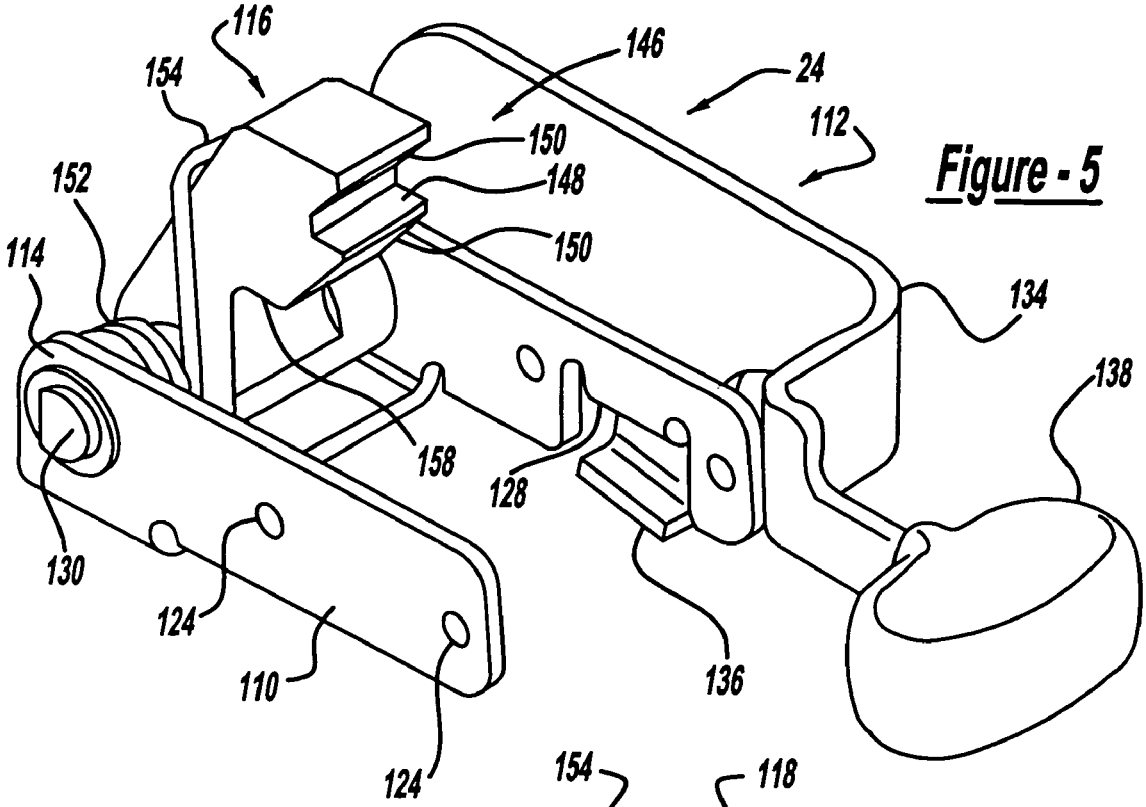
FIG. 5 is a right side perspective view of the adjustable seat mechanism shown in FIG. 4.
Figure 6:
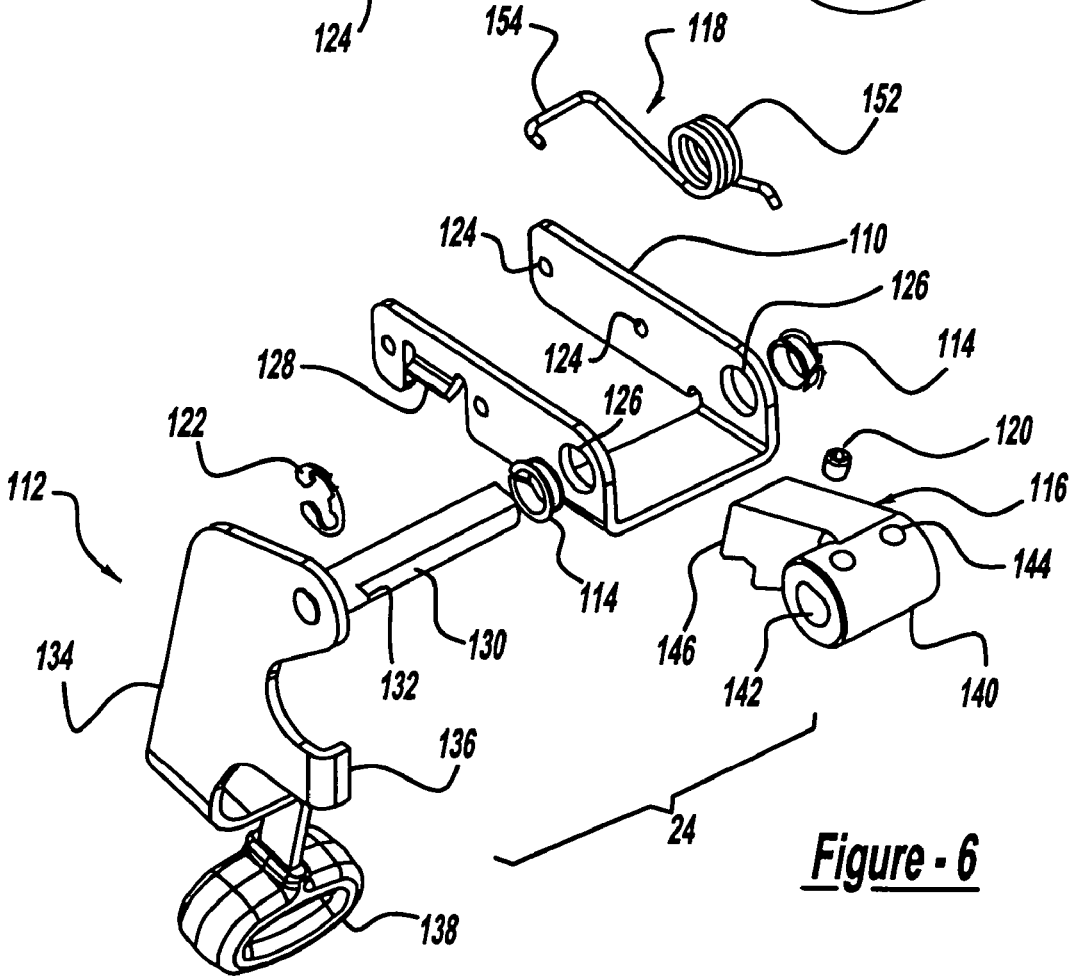
FIG. 6 is an exploded view of the adjustable seat mechanism shown in FIGS. 1, 4 and 5.

As illustrated in FIGS. 5 and 6 in detail, the latching portion of the adjustable seat mechanism 24 includes a U-shaped latch support bracket 110, a link shaft assembly 112, bushings 114, a latch member 116, a latch spring 118, retaining screws 120 and a retaining ring 122. The U-shaped bracket 110 includes apertures 124 and 126 formed therein, and a detent or stop 128. The link shaft assembly 112 includes a shaft 130 having flat surfaces indicated at 132, a stepped bracket 134 having a tab portion 136 and a latch release handle 138. The latch member 116 includes a cylindrical portion 140 having a bore 142 formed therethrough and apertures 144 formed therein for receiving the retaining screws 120, and a rack engagement portion 146. The rack engagement portion 146 is configured with a normally horizontal flat surface 148 and a pair of angled surfaces 150. The latch spring 118 includes a circular portion 152 and a L-shaped portion 154.

With continued reference to FIGS. 5 and 6, the retaining ring 122, the bushings 114, the latch member 116 and the latch spring 118 are secured to the shaft 130 of the link shaft assembly 112. Accordingly, the shaft 130 of the link shaft assembly 112 extends through the apertures 126 formed in the U-shaped bracket 110, through the bore 142 formed through the tubular portion 140 of the latch member 116 and through the circular portion 152 of the latch spring 118. While mounted on the shaft 130, the L-shaped portion 154 of the spring latch 118 engages the latch member 116. The torque screws 120 are inserted through the apertures 144 formed in the tubular portion 140 of the latch member 116 and engage the flat surface 132 of the shaft 130 to keep the latch rack 116 properly positioned on the shaft 130. Similarly, the retaining ring 122 and the bushings 114 aid in keeping the above described assembly in proper position.

Figure 4:
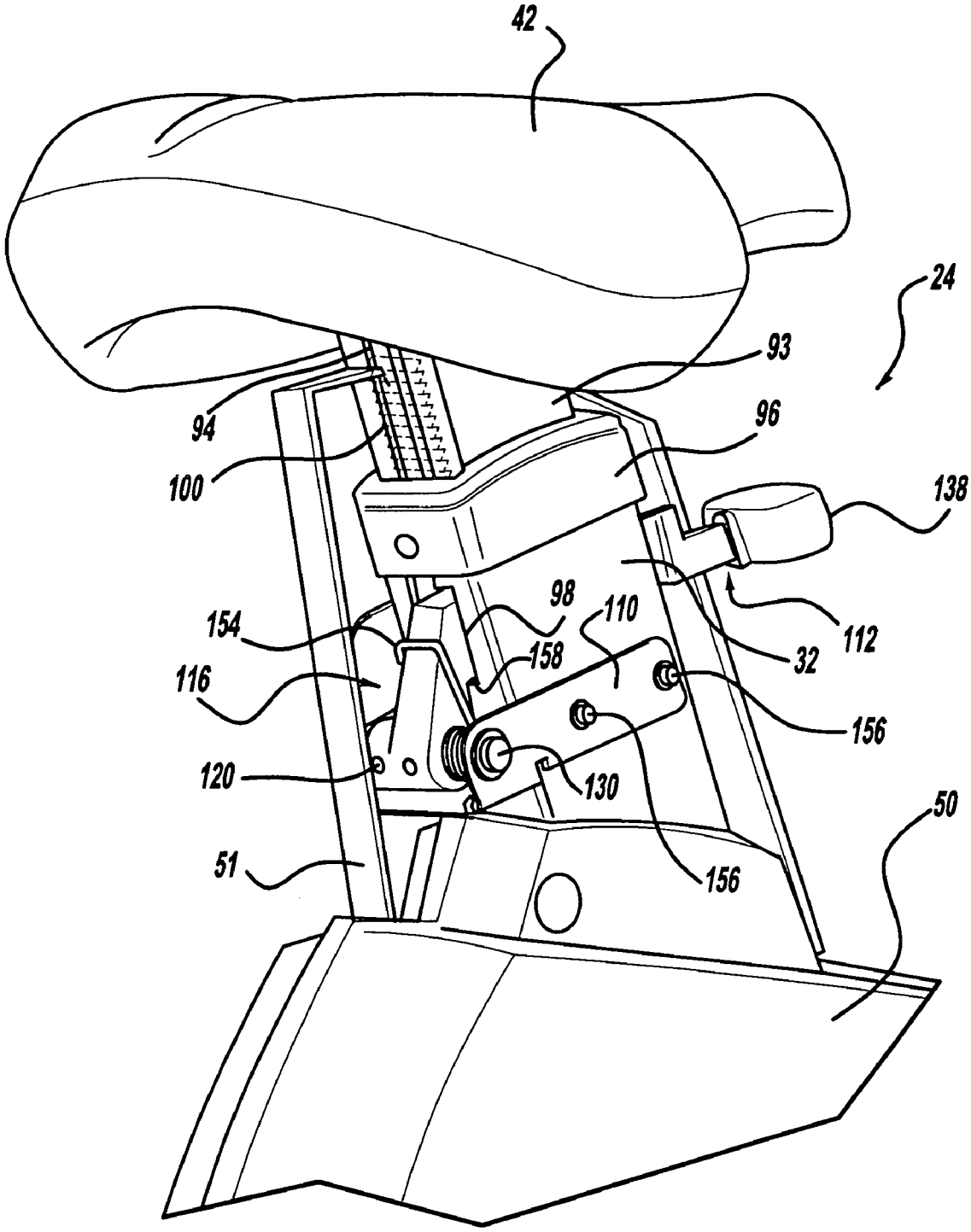
FIG. 4 is a right side perspective view of an adjustable seat mechanism for use with the stationary exercise bicycle apparatus in FIG. 1.

The adjustable seat mechanism 24 can be mounted to the support member 32 by any suitable mounting means. An example of such is illustrated in FIG. 4 wherein a set of self tapping screws 156 are inserted through the apertures 124 formed in the U-shaped bracket 110. When mounted on the seat post support member 32, the latch member 116 extends through the aperture 98 formed in the support member 32. The lower edge of the aperture 98 serves to support a lower flat surface 158 of the latch member 116 thereby supporting the weight of the post tube 93 along with the weight of the user on the seat 42. As a result of the geometry of this combination of the latch member 116, the rack 100 and the lower edge of the aperture 98, this mechanism becomes a self locking mechanism where the latching or locking effect becomes greater with increasing load on the seat 42.

Figure 9:
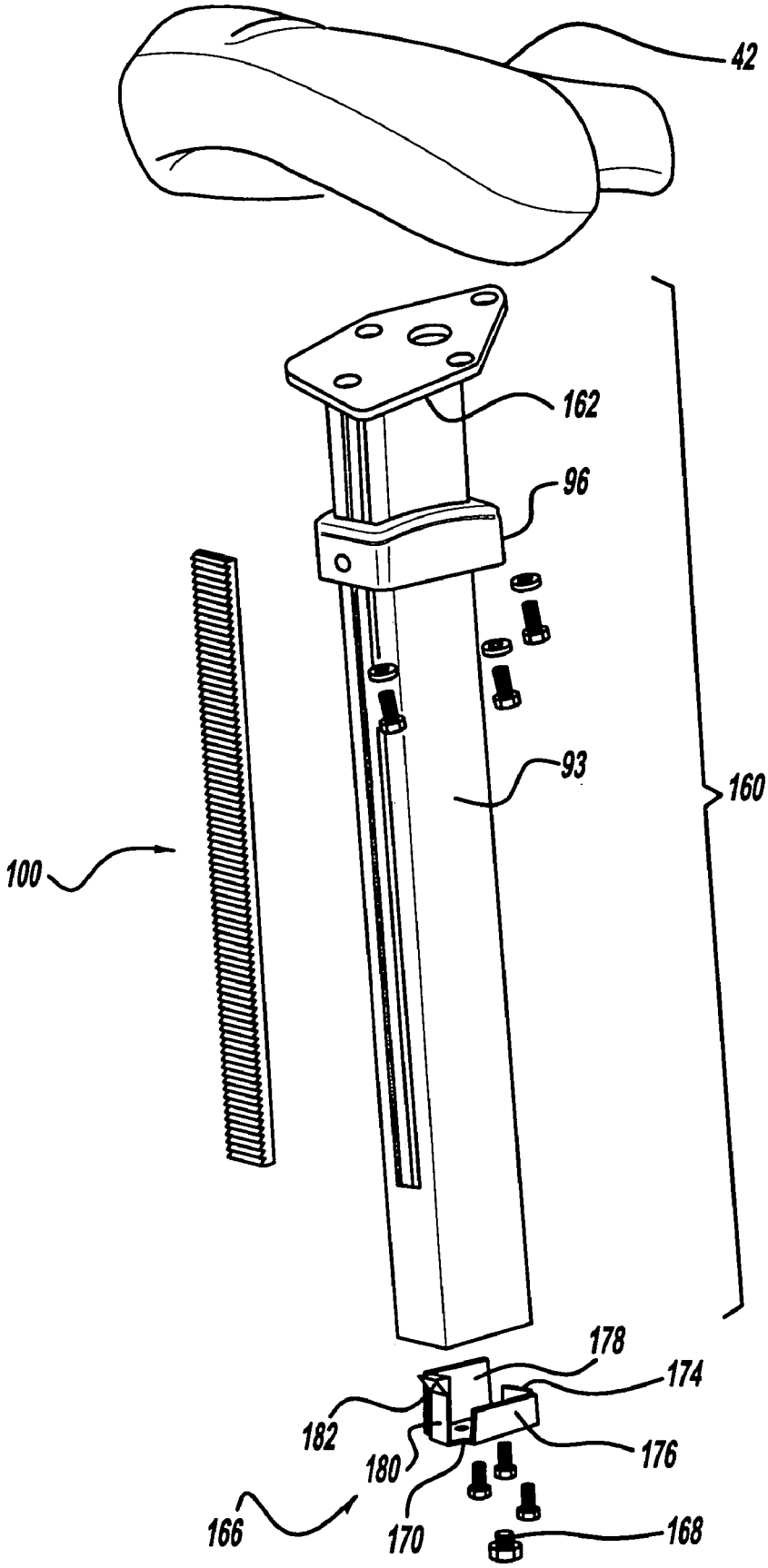
FIG. 9 is a rear perspective view of a seat post for use with the adjustable seat mechanism of FIGS. 1 and 4-8.
Figure 10:
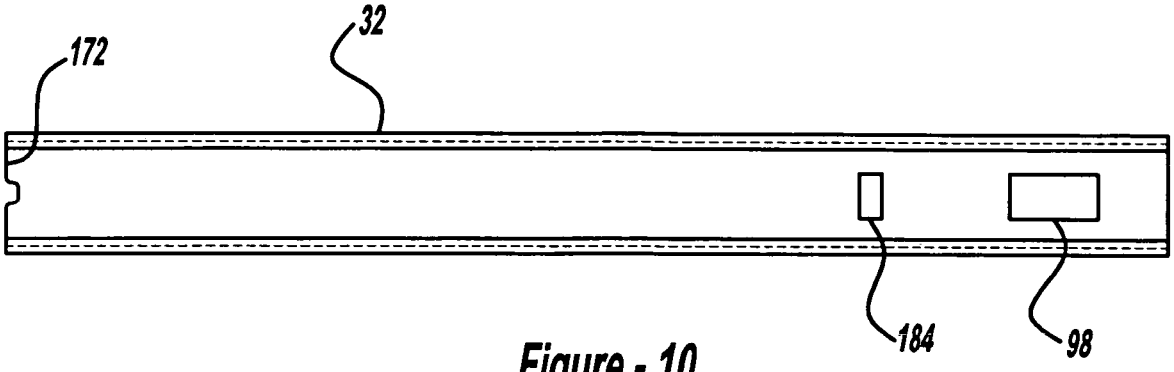
FIG. 10 is a rear view of a vertical seat post support member for use with the adjustable seat mechanism of FIGS. 1 and 4-9.

FIG. 9 in connection with FIG. 10 illustrates the preferred embodiment of a seat post assembly 160. This assembly 160 as shown in FIG. 9 includes the seat post 93, the rack 100 and the collar 96. In addition the seat post assembly 160 includes a plate 162 for supporting the seat 42 and a guide base 166. The guide base 166 fits over the bottom of the seat post 93 and is preferably a one piece molded plastic part. A polyelastomer bumper 168 is secured to the bottom portion 170 of the guide base 166 in order to cushion the impact of the seat post 93 on a bottom surface 172 of the seat post support 32 shown in FIG. 10 when the seat post 93 is moved to its lowest position in the support 32. Integral with the bottom portion 170 of the guide base 166 are a pair of vertical bearing surfaces 174 and 176 along with a pair of stabilizer arms 178 and 180. The stabilizer arms 178 and 180 are configured so as to be compressed inwardly when the guide base is inserted into the seat post support 32 and operate in combination with the bearing surfaces 174 and 176 to provide for smooth movement of the lower part of the seat post 93 in the support 32. In addition, the stabilizer arm 180 includes an outward projection or stop 182 that is configured to engage an aperture 184 configured in the seat post support member 32 as shown in FIG. 10. This will prevent a user from inadvertently pulling the seat post 93 out of the support 32 when lifting the seat 42.

The adjustable seat mechanism 24 functions as a ratchet mechanism. Normally, as discussed above, when the user is on the seat 42, the seat 42 is locked against downward movement as the flat surface 148 of the tooth portion 146 of the latch 116 is engaged with the horizontal surface 106 of two of the teeth 104 of the rack 100 and as the surface 158 abuts the lower edge of the aperture 98. The spring 118 tends to bias the release handle 138 in a downward direction into its normal position. If the user desires to raise the seat 42, the user simply pulls the seat upward, causing the seat mechanism 24 to ratchet upward. During this upward racheting, the angled surfaces 150 of the tooth portion 146 of the latch 116 simply slide over the next lower angled surface 108 of the teeth 104 of the rack 100. When the desired vertical position is achieved, the seat 42 will be locked in place as previously described above. If the user desires to lower the seat 42, the user simply pulls up on the release handle 138 of the link shaft assembly 112 causing the latch 116 to rotate to the rear on the shaft 130 overcoming the biasing force of the spring 118, which in turn, causes the flat surfaces 148 of the tooth portion 146 of the latch member 116 to disengage from the horizontal surfaces 106 of the teeth 104 of the rack mechanism 100. The tab portion 136 of the link shaft assembly 112 serves to limit the amount of upward movement of the handle 138 by abutting against the detent stop 128 formed in the U-shaped bracket 110. Once the desired vertical position is achieved, the handle 138 is released, whereupon the spring 118 will cause the latch member 116 to rotate forward and the seat 42 is locked in place as previously described.

Accordingly, the adjustable seat mechanism 24 allows the user to select the optimum seat position since the closely spaced teeth 104 permit a fine height adjustment for the seat 42 of about one half inch. The seat mechanism 24 also provides the user with a particularly convenient method for seat height adjustment. All that is necessary to raise the seat 42 is to simply pull it up. And to lower it, all that is necessary is to lift the release handle 138 up to disengage the latch member 116 from the rack 100. In addition to the relatively fine seat adjustment, this mechanism 24 has the advantage of allowing a user to adjust the seat 42 both up and down by merely standing on the pedals 18 and either pulling the seat 42 up or using the release handle 138 to lower the seat 42. It is not necessary for the user to get off the apparatus 10 to pull a pin as in other types of seat adjustment mechanisms.

Although the present invention has been described in terms of its preferred embodiment, it will be appreciated that various changes and modifications will be suggested to one skilled in the art and it is intended that the invention encompass such changes and modifications as fall within the scope of the appended claims.

We claim:

1. A stationary exercise bicycle comprising:

a frame adapted for placement on a stationary horizontal surface;

a seat mounted on said frame;

a first pedal and a second pedal movable with respect to said frame in a generally circular direction;

a shaft having first and second ends rotatably secured to said frame;

a first and a second hub member secured to said first and second ends respectively of said shaft for rotation therewith;

a first crank arm having a first end secured to and for rotation with said first hub member about a common central longitudinal axis and a second end rotatably connected to said first pedal;

a second crank arm having a first end secured to and for rotation with said second hub member about said common central longitudinal axis and a second end rotatably connected to said second pedal;

wherein said first and second ends of said crank arms are configured with a mounting portion each said mounting portion having a plurality of fastener receiving apertures and wherein said first and said second hub members include a plurality of apertures aligned with said mounting apertures and wherein a plurality of fastener members are inserted through said mounting apertures and said hub member apertures to secure said crank arms to said hub members; and a drive member secured to said first hub member for rotation therewith.

2. The bicycle of claim 1 wherein each of said first and second ends of said shaft are configured with a noncircular surface and said first and second hub members are configured with central apertures configured to engage said noncircular surfaces of said first and second ends of said shaft.

3. The bicycle of claim 1 wherein said first and second hub members are configured with a central aperture and are secured to said first and second ends of said shaft by a fastener member insert through said central apertures.

4. The bicycle of claim 1 wherein said drive member is configured with a plurality of apertures aligned with said first hub member apertures and a first set of said fasteners additionally serves to secure said drive member to said first hub member.

5. The bicycle of claim 4 wherein said drive member is secured between said first hub member and said frame.

6. The bicycle of claim 1 wherein said shaft is supported in said frame by a crank bushing and at least one bearing and secured in said frame by a plurality of retainer rings.

7. The bicycle of claim 1 wherein said first and second ends of said shaft are configured with tapered noncircular surfaces and said first and second hub members are configured with central apertures configured to engage said noncircular surfaces of said first and second ends of said shaft and are secured to said first and second ends of said shaft by a fastener member inserted through each of said central apertures.

8. The bicycle of claim 1 wherein said first hub is secured to said shaft by a fastening member having a threaded first end and a washer wherein said first end of said fastening member is threaded into said first end of said shaft and said washer is located between said first hub and a second end of said fastening member.

9. A stationary exercise bicycle comprising:

a frame adapted for placement on a stationary horizontal surface;

a seat mounted on said frame;

a pedal;

a shaft having a first end configured with a noncircular cross section rotatably secured to said frame;

a hub member having a central aperture engaged with said first end of said shaft for rotation with said shaft;

a drive member secured to said hub member for rotation therewith;

a fastening member extending through said hub and said drive member into said first end of said shaft effective to secure said hub member and said drive member to said shaft; and a first crank arm having a mounting end secured to and for rotation with said hub member about a common central longitudinal axis and a second end rotatably connected to said pedal;

wherein said mounting end and said second end of said crank arm are configured with a mounting portion each said mounting portion having a plurality of fastener receiving apertures and wherein said hub member includes a plurality of apertures aligned with said mounting apertures and wherein a plurality of fastener members are inserted through said mounting apertures and said hub member apertures to secure said crank arm to said hub member.

* * * * *